United States Patent [19]

McMullen

[11] 4,281,784

[45] Aug. 4, 1981

[54] MAGNETIC STRIP SEPARATOR

[76] Inventor: James W. McMullen, 696 Youngstown-Kingsville Rd., Vienna, Ohio 44473

[21] Appl. No.: 32,936

[22] Filed: Apr. 24, 1979

[51] Int. Cl.[3] ..... B65H 17/42

[52] U.S. Cl. ..... 226/118; 226/113

[58] Field of Search ..... 226/104, 113–119; 271/193, 221–224; 198/679

[56] References Cited

U.S. PATENT DOCUMENTS

| | | | |
|---|---|---|---|
| 2,193,162 | 3/1940 | Carter | 198/679 |
| 2,750,187 | 6/1956 | Bannister et al. | 226/42 |
| 2,830,809 | 4/1958 | Morocco et al. | 226/104 |
| 3,515,327 | 6/1970 | Bortmus | 226/113 |
| 3,606,313 | 9/1971 | Buccicone | 271/193 X |
| 3,687,348 | 8/1972 | Scheib | 226/113 |

*Primary Examiner*—Leonard D. Christian

*Attorney, Agent, or Firm*—Sixbey, Friedman & Leedom

[57] ABSTRACT

A magnetic strip material supporting looper system including one or more traversing looper cars with looper rolls thereon, operable in a moving magnetic material strip processing line to accumulate and store, and refeed, strip material for continuous strip movement and processing, while accommodating strip stoppage at entry and/or delivery stations and the like, the strip being accumulated in horizontal loops, each constituting upper and lower runs of strip material upon operational traversing of the looper cars, the lower run strands being supported from below the strip on a series of spaced rolls arranged to support the strip without interfering with travel of the looper cars, the upper run strands of material being magnetically supported from above and separated from the lower run strands thereof by a combined arrangement of horizontal, nonmagnetic, material contacting rotatable rolls and elongate magnetic means interposed therebetween, the upper run strands being supported and maintained in rolling contact with the lower peripheries of the nonmagnetic rolls by the interposed magnetic means, the magnetic means being vertically adjustably positioned in spaced non-contacting relation above the strip, the upper run strands being so supported as to prevent interference with travel of the looper cars.

12 Claims, 4 Drawing Figures

PROCESS SECTION OF LINE
ENTRY END OF LINE
PROCESS SECTION OF LINE

MAGNETIC STRIP SEPARATOR

TECHNICAL FIELD

This invention relates to strip processing lines for magnetic materials using horizontal loops as a method of temporarily storing and dispensing strip. Traversing looper cars accumulate the strip and form top and bottom strands of the loop, with the top strand being supported in spaced relation above the lower strand. Magnetic means are located at appropriate intervals to support the top strand from above, and in a manner to obviate possible interference between the strip support means and the looper cars.

BACKGROUND ART

Many current strip processing lines used in the processing of continuous metal strips, such as in pickling processes for example, use long horizontal loops in a so called horizontal loop system as a means of temporarily storing the strip, so that the processing section of the line may run continuously, while the entry and/or delivery sections of the line are stopped to permit, for example, welding attachment of a trailing strip edge to a leading succeeding strip edge, in a usual manner, in continuous strip processing.

The means of storing strip or accumulating strip, is normally accomplished in a system by means including looper cars on which are mounted looper rolls. The strip is passed around the looper rolls and the looper cars are traversed back and forth along tracks so that the strip is stored and accumulated in loops consisting of upper and lower strand runs. The strip can be stored and accumulated, or fed back into the processing line, depending upon the direction of movement of the looper cars. In such a system or process, it is necessary, however, that the top strand of the loops thus formed be supported from sagging down and engaging the bottom strands. The systems can include a plurality of looper cars, with looper rolls, at opposite ends of the processing line, such as entry and delivery ends, depending upon the amount of strip it is necessary or desirable to store for a specific process installation involved.

Current apparatus and practices utilize various types of supports, including support rollers positioned at intervals under the top loop strand, or between the top and bottom strands. Such supports, however, must be removed from the path of a looper car as the loop is shortened, during refeed of strip, and must be reinserted at intervals after passage of the looper car as the loop lengthens. Such a system requires some means of signaling the position of the car relative to the position of the support device so as to initiate its movement at the proper time, and additionally requires application of a motive force to the support to move and accelerate, and decelerate, the mass of the support device as it moves into or out of the path of the rapidly moving looper car.

Some currently known and used signaling and support roller moving means, including electrical and mechanical devices, as also air and hydraulic devices, for moving the rollers, all have a common drawback in that failures can occur, and heretofore such known support devices have for the most part included a common characteristic of being in the path of the looper car when supporting the strip. Any failure of the electrical, air, hydraulic or mechanical signaling means, or the means for applying the motive force to move the supports, therefore usually results in a collision of the support device with the looper car, or with the strip or both, with possible substantial damage to one or more of the components. In turn, this damage results in costly repairs and maintenance, and, of substantial importance and significance, to costly loss of production due to line stoppage to clear wreckage and perform needed repairs.

Some known apparatus and systems additionally frequently involve many moving parts which require so called operational down periods for the purpose of lubrication, maintenance, and eventual replacement due to wear.

Typical prior art strip looping systems, such as used in strip processing lines of the type with which the present invention is concerned, are disclosed for example in U.S. Pat. No. 3,515,327, issued June 2, 1970 to H. J. Bortmus; U.S. Pat. No. 2,830,809, issued Apr. 15, 1958 to P. Morocco et al; and U.S. Pat. No. 2,750,187, issued June 12, 1956 to B. Bannister et al.

The Bortmus and Morocco patents utilize strip supports positioned below the upper strand run of the loop, and these support means must be moved out of the path of the traversing looper car. In Bortmus the support rollers pivot out of the path of a looping roll during looping roll movement resulting from a decrease in loop size as the material is fed into the processing run for processing continuity. In Morocco the supporting rolls are positioned beneath the strip in the upper run, with the plurality of strip-supporting rollers having adjacent runs thereof interconnected by a pair of chains, with the rollers in the line being collapsible and expandible with respect to each other to prevent damaging contact between stationary and movable rolls.

The Bannister patent discloses a looper system wherein an upper run of the loop is suspended or supported by magnetic conveyor rollers, with the lower or return run being carried on ordinary rollers or skids. The magnetic rollers are positioned or supported by means of brackets extending as cantilevers, and the magnetic rollers are designed to exert sufficient magnetic attraction to suspend the upper run of the loop of steel strip through supporting contact with the top or upper surface of the strip material. In this system, however, the fed or moving strip comes into tangential contact with the magnetic rollers progressively at their lowest points. While the strip of steel is supported from above in this patent, in a horizontal loop, by magnetic rolls, it is to be noted that when these magnetic rolls are used, the magnetic field is rather limited in area, and only a single line contact is made with the strip. In use, the apparatus of Bannister has certain drawbacks. A more elaborate discussion of the differences and drawbacks appears hereinafter following a detailed presentation of the present invention.

Another existing looper system is shown in U.S. Pat. No. 3,687,348, issued Aug. 29, 1972 to William R. Scheib. This patent is typical of the known patent art dealing with conventional looper car structures and systems with which used. This patent also involves the use of movable strip support rollers.

Also known in the art are metal sheet magnetic conveyor systems or apparatus such as shown for example in U.S. Pat. No. 3,606,313, issued Sept. 20, 1971 to D. Buccicone. This same inventor additionally has been the recipient of several other U.S. patents all relating to similar overhead magnetic conveyor units. While overhead magnetic conveyor units are well known in the patent art, as exemplified by the Buccicone patent, these patents do not teach or suggest the combination with a looper car in a strip processing line of the magnetic support concept in the manner of the present invention.

SUMMARY OF THE INVENTION

A strip looper system for magnetic metal strip processing lines is provided for temporarily storing a variable length of strip material in spaced upper and lower runs of strip and wherein at least one traversing looper car mounting a looper roll maintains the strip in substantially parallel vertically spaced upper and lower horizontal strands or runs, with the looper car being movable to selectively increase, and/or decrease selectively, a length of strip material accumulated and stored in the strip processing line, and to selectively refeed the stored strip to accomodate, in a continuous processing run of the magnetic strip material, a strip stoppage of entry and/or delivery sections of the line. The metal strip is magnetically supported from above by magnetically operating means including elongate magnetic bar means arranged between, and substantially coextensive with, non-magnetic rolls at spaced intervals positioned closely above the top surface of the upper strand of the strip. The magnetic bar means and non-magnetic rolls are relatively positionally adjustable, with the lower surface of the bar means being spaced vertically above the lowermost roll surfaces, and operable to operatively maintain the upper run of strip in a substantially rectilinear or straight horizontal path, with rolling contact with the bottoms of the rolls, and slightly spaced from the magnetic bar means by an air gap to obviate frictional rubbing contact with the bar.

The present invention accordingly is directed to magnetic force creating means for supporting a metal strip in a looper system for accumulating and storing, and selectively refeeding, magnetic strip material by means of at least one traversing looper car mounting a looper roll, the arrangement being such that the top strand of a horizontal loop, so formed, is supported from above by a system of rollers and magnets in a manner whereby no parts of the strip supporting system are in the path of a looper car.

In one aspect of the present invention, a system is used to support the top strand, from above the strand, by a system of rollers and banks of magnets, either permanent or electro-magnets, in such a manner that no parts of the supporting system are positioned in the path of a looper car utilized in the system. The rolls and magnets are positioned at spaced intervals above the top strand of the horizontal loop, or the pass line of the top strand of the loop, and preferably supported on structures, usually existing, on either side of the looper car path, i.e., outside the path of the looper car. The top strand can thus be supported by magnetic force.

The present invention further and more specifically provides strip support means for magnetic strip material, or a system to support the top strand from above by a system of rollers and magnets, either permanent magnets or electro magnets, such that no part of the supporting system is in the path of a looper car as it traverses in either the accumulator or dispenser phases or modes of the system. The magnetic means and system preferably includes banks of electro-magnets, or permanent magnets, located between non-magnetic rolls, with the roller combinations being spaced at appropriate intervals close above the pass line of the top strand of the loop, and with the magnets being spaced slightly above the lowermost peripheral surfaces of the rollers. The top strand is pulled up against the rollers and maintained in a substantially straight or rectilinear horizontal line in rolling line contact with the rolls, and removed by an air gap from rubbing frictional contact with the magnets. The apparatus or system for so supporting the top strand contains no moving parts other than the rotatable rolls.

Where electro-magnets are used, means can be provided to de-energize those which are not required to support the strip, so that as the loop is shortened the magnets beyond the loop are de-energized, but are subject to being reenergized as the looper car approaches, as the loop is extended. The magnets can consist of permanent magnets, which remain energized, or electro-magnets that can be energized or deenergized as required by the position of the looper car by supplying, for example, a signal from a rotary limit switch coupled to the cable drum of the looper car drive.

The present invention results in a system and construction in a looper system wherein horizontal loops are formed by traversing movement of looper cars carrying looper rolls thereon, wherein collision between looper cars and strip material supports are eliminated, as also collision between supports and strip. A substantial reduction in routine maintenance and replacement of parts due to wear of moving parts is obtained, as also a reduction in downtime on the line.

Additional objects, advantages and features of the invention will be more readily apparent from the following detailed description of a preferred embodiment of the invention when taken together with the accompanying drawings.

BEST MODE FOR CARRYING OUT THE INVENTION

Figure 1:
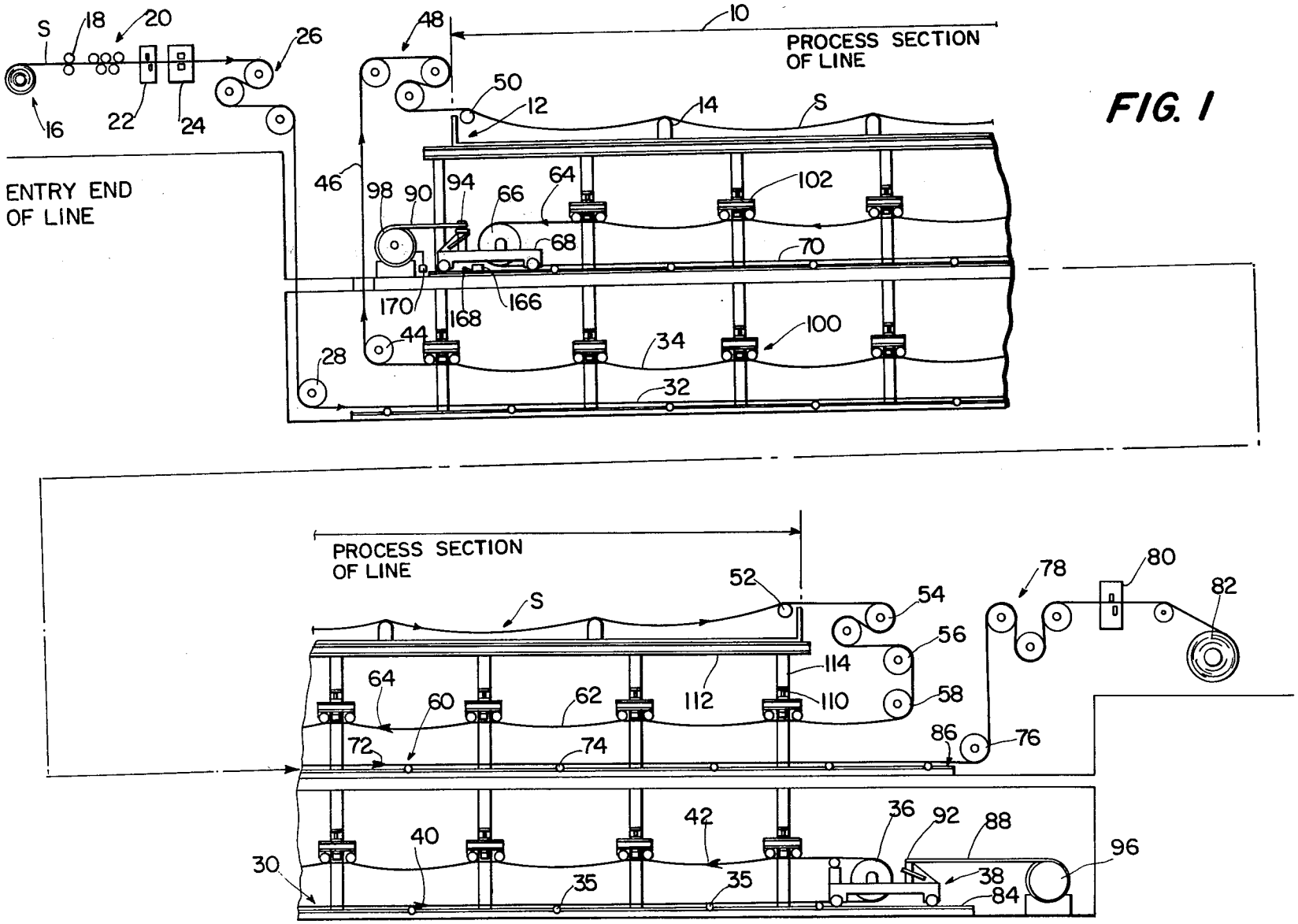
FIG. 1 is a schematic elevational diagram of an overall magnetic material strip processing line, such as a pickling process, and with entry and exit horizontal looper car storage systems, embodying the principles of the present invention, only single cars being shown at the line ends for simplicity although plurality of such cars can be utilized in any given system.

The overall looper system as shown for example in FIG. 1 is basically of a known type, and reference is here made to the aforementioned U.S. Pat. Nos., including 3,687,348 and 3,515,327, for the overall looper assembly as utilized in a strip processing line.

Basically, in the embodiment shown, the magnetic metal strip S to be processed runs through the process section of the line, indicated generally at 10 with the line and end arrows. In the illustration, the process is one for strip pickling. The strip passes through a pickling bath, the container for the pickling material being shown at 12, and is of a known type with the strip passing in immersed condition in the liquid of the bath, and generally supported by a plurality of stands as at 14. The strip to be processed is continuous, and to this end the strip is drawn off from a coil mounted as usual in an uncoiler or payoff roll, 16, with the strip passing, as is usual, between pinch rolls 18 and roller levelers 20. Such coils of strip material however are of a terminated length, and in order to provide for continuous run through the process it is necessary to join the trailing end of a sheet from one roll to the leading edge of a succeeding sheet from an additional roll. To this end an entry or squaring shear 22, and an end welder 24, are incorporated in the line. The strip then passes around a series of rollers 26, which in effect constitute tensioning and guide rolls at the entry end of a strip storing and feeding section, commonly known in the art as a looper or loop section. As used in the art, a strip accumulator or storage device must be provided in which a substantial length of strip can be stored, and from which it can be released as required. This is necessitated since, as pointed out above, the strip is available only in coils of terminated length and, in order to provide for continuous strip movement and processing, the strip forming the portion which moves continuously requires a momentarily interrupted movement of a trailing strip end, while the leading end of a new strip is secured thereto in the welder unit 24. The strip accumulator serves to continuously feed strip to the processing or operating portion of the line from the looper or storage section during this period of interruption, for attachment of successive sections.

Accumulators for strip material, as evidenced by the aforementioned patents, serve to support strip in one or more loops which are variable in size to vary the length of strip stored. In many installations these loops of the looper system are of substantial length, and the loops generally are horizontally arranged. For substantial storage lengths, it is necessary to include a multiple array or arrangement of the loops in a vertical manner, or in other words to have plural loops vertically positioned one above the other. Such a looper system is shown in FIG. 1. The strip, following passage through the rollers 26, passes under a roller 28 which is the lower entry roller of a bottom accumulator or looper section 30. As will appear hereinafter, the strip material must be supported both in the bottom or lower run of strip, indicated at 32, as also in the upper or top run 34. Typical skewed rollers 35 can, in a known manner, operatively support the strip in the lower run 32, support of the lower run being quite simple. The upper run or reach, however, has presented problems in the art, occasioned at least in part by excess sagging of long lengths or runs of unsupported strip material.

As shown in FIG. 1, the strip material passes through the lower or bottom looper section 30, referring to the lower strand 32, and then passes around a looper roll 36 operatively mounted on a looper car 38, both of which are generally known. After passing around looper roll 36, the strip material passes in a reverse direction to that of the lower run or reach 32, the upper run being designated 34, the direction or path of travel of the strip being indicated by arrows 40 in the lower strand run, and 42 in the upper strand or reach. It is in this upper reach that problems have occurred in supporting the strip and, as is also known in the art, the upper strip reach must be maintained separated from that of the lower run for operational reasons. The details of the upper run support constitute the essence of the present invention, as described in detail hereinafter.

The strip material, after passing through the bottom looper section, extends around roller 44 in a substantially vertical path 46, thence around a plurality of tensioning and guide rollers, generally indicated at 48, which serve to draw and feed the strip material into the processing section of the line. This consists of a pickling bath solution in the container 12, and the strip passes through the pickling liquid while being positionally maintained by stands 14. An entry roll 50 for the strip at the entry end of the bath is provided, and after passing through the bath an exit end roller 52 serves to support the outwardly fed and processed portion of the continuous strip material. The strip then passes around plural feed and guide rolls 54, and thence is passed around inlet or entry rollers 56 and 58 into an upper or top looper section generally designated 60, which is similar to the lower or bottom looper section 30. In this upper looper section, the processed strip material passes along in an upper run 62 which must be supported in a manner similar to the upper run or strand 34 in the lower looper section 30, all of which is described in detail hereinafter, again with arrows 64 indicating the path of travel in this upper strand run. The strip thence passes around an exit looper roll 66 of the upper looper section 60 which is mounted on a looper car 68 similar to the car 38. The strip then passes along a lower reach or run 70, as indicated by arrows 72. This lower run 70 is supported in a usual manner by skewed rollers 74 similar to those in the lower looper section. These typical skewed rollers 74, 35 are known in the art, and it is also known that the lower runs present little, if any, support problems, and no interference problems with moving looper cars exist. Again as previously pointed out, it is the upper run which requires a novel and unique support for functional reasons.

After passing along lower run 70 in the upper looper section 60, the strip passes around an exit roll 76, feed and guide or tensioning rolls 78, thence through an exit shear 80, and to a tension roll 82 at the exit end of the line. The strip can then be further processed in a desired manner.

The foregoing specific description has generally related to the strip processing line of FIG. 1, with entry and exit horizontal looper car storage systems, which serve to accumulate and store strip material so that a continuous run for processing of the material is afforded, while at the same time providing or accommodating to the necessary momentary interruption of strip run for processing such as welding, and/or shearing or cut off at the exit end of the line, to permit reroll of the processed material for further treatment. The lower looper run accommodates the entry shear and welder units 22 and 24, as above described, while the upper looper section 60 accommodates the exit shear 80 and reroll unit or tension roll 82 at the exit end of the line.

The essence of the present invention resides in magnetic strip supporters and separator units used to maintain the upper runs or strands 34, 62 spaced above and separated from the lower run strands 32 and 70. The looper cars 38, 68 traverse on rails, the lower car 38 being shown as operationally mounted on rails 84, and the exit looper car 68 operationally mounted on rails 86. As broadly shown in FIG. 1, cables 88, 90 are respectively attached to posts 92, 94 on looper cars 38 and 68, with the cables passing around car winches 96, 98 for the respective cars. Again, reference is made to the aforementioned patents disclosing the function and operation of looper systems.

Figure 2:
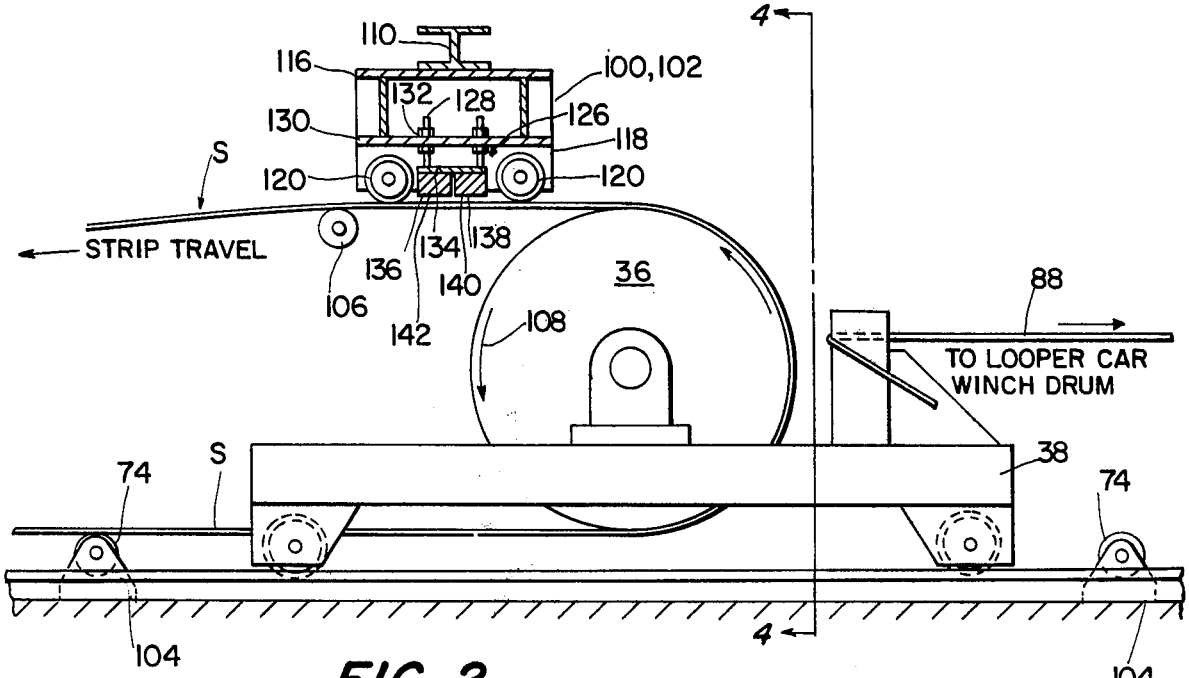
FIG. 2 is a fragmentary enlarged side elevational view of a portion of the system shown in FIG. 1, and illustrating in greater detail the construction of a looper car, with looper roll, and a magnetic suspension and strip separator unit incorporating the present invention.

The present invention differentiates from the known systems principally in the novel magnetic support means or units. These magnetic support and strip separator units, designated 100 for the lower looper section, and 102 for the upper looper section, are identical, and a single unit of a preferred embodiment is shown in detail in FIG. 2. The unit in FIG. 2 is designated with a double designation 100, 102, since it is the same in both loops. FIG. 2 also shows in greater detail a looper car, looper roll, and control and functional portions of the system for the looper car. Additionally, the lower support rolls 74, as mounted on roll supports or brackets 104, are shown supporting the lower run of the strip, and these rolls 74 are typical skewed rollers.

As is generally seen in FIG. 1, the strip material which extends between, and is supported from, the magnetic strip support and separator units such as 100, 102, tends to sag in a catenary manner. The supporter units compensate for this and generally speaking will tend to maintain or support the strip at the separator and support units in a relatively straight or rectilinear line. As shown in FIG. 2, the looper car includes an exit support roll 106 which, in conjunction with the periphery of looper roll 36, rotating in the direction of arrows 108, for a discharge or reentry passage of the strip tends to support it and bring it into substantially intimate contact with the magnetic strip support and separator unit as shown. The indicated directional movement here is that which occurs during a momentary interruption of strip movement at the entry end of the line, and a similar reentry of strip will be provided at the exit end of the line by movement of the upper looper car 68.

Figure 3:
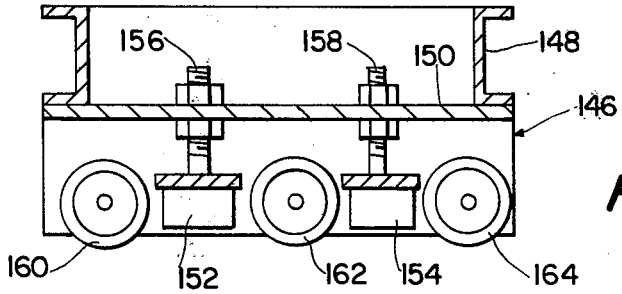
FIG. 3 is a schematic sectional view of a second embodiment of a magnetic strip support and separator unit, differing from the embodiment shown in FIG. 2 in the inclusion of a plurality of interspersed rolls and rows of magnets in alternated positions.

The magnetic strip support and separator units per se are shown in greater detail in the upper portion of FIG. 2, and FIG. 3 shows a modified form. The unit 100 in FIG. 2 is attached to a supporting structure generally designated 110, shown as an I-beam, and of a nature and structure frequently found in conjunction with processing lines, and which additionally can be tied in with the existing structure as shown in FIG. 1. These supports 110 are shown as depending from supports 112 for the pickling bath 12 by interposed vertical members 114, for the upper looper section, with the units for the lower looper section being interconnected with the supports, for example, for the rails for the upper or exit looper cars. The actual structure of these supports is immaterial, but of substantial significance is the fact that the units 100, 102 are positioned and maintained out of possible contact by the looper cars as they traverse in their functional movement in the looper sections.

Figure 4:
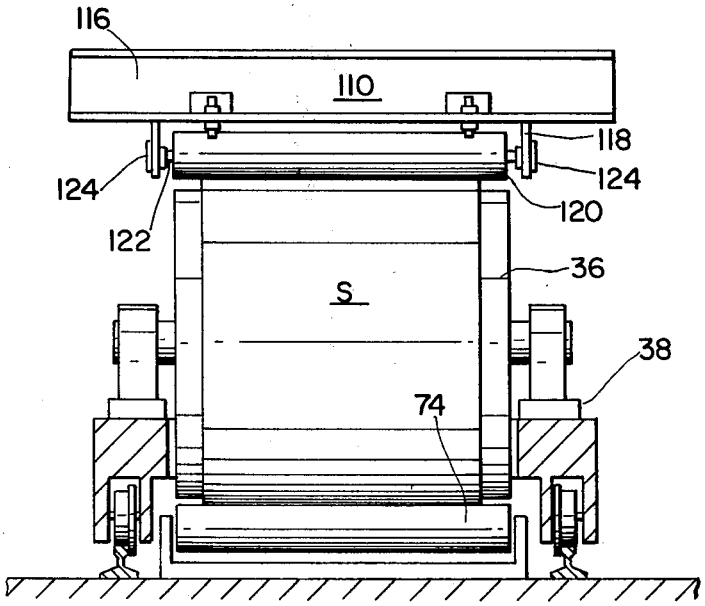
FIG. 4 is an elevational view taken substantially at right angles to FIG. 2, and substantially along line 4—4 of FIG. 2.

The unit per se, in FIG. 2, includes a structural member 116 attached in any desired manner to the supporting structure 110. The member 116 has legs 118 (FIGS. 2 and 4) depending therefrom in spaced relationship and which support rolls 120, on shafts 122 in bearings 124. These rolls are functionally operable to contact, in a rolling relationship, the upper surface of the strip as it passes thereunder during normal operation of the looper sections. This rotational engagement is shown in FIG. 2. The upper surface of the strip is maintained substantially in rolling contact with the roll along a line, by means of magnets generally designated 126, and which are described in greater detail hereinafter. These magnets, generally speaking, are supported for vertical adjustment by means of threaded support bolts 128 extending through horizontal beam portions 130, with vertical adjustment being provided by means of coacting nuts 132. The lower ends of the bolts 128 are attached to plates, in this embodiment, indicated at 134, and which preferably extend transversely of the strips, and substantially coextensive with the length of the rollers 120. The plate is disposed between the horizontally spaced rollers and as close as feasible therebetween, and serves to mount the magnets.

The vertical positionment is adjustable so as to provide a small air gap at 136 between the bottoms 138 of the magnets 140 and the upper surface of the strip. This allows vertical adjustment of the magnets with respect to the bottom surface of the rolls, and serves to bring the strip passing over the looper car roll into the magnetic force field of the magnet, and into very close proximity with the magnets. The magnetic force lifts the strip toward the magnets until the strip engages the rolls on either side of the magnets. The magnetic attraction may cause the strip to deflect slightly upward between rolls, but the amount of such deflection is a function of the tension in the strip, the stiffness of the strip, the span between rolls, and the strength of the magnetic attraction. These factors can be controlled to insure the strip does not deflect upward far enough to make contact with the magnet surface, and when the gap is properly adjusted for strip gauge and tension. This insures that the strip has only rolling contact, with the rollers, and does not frictionally engage or abrade, the magnet surfaces. The rollers 120 are non-magnetic, and the arrangement is such that the magnets serve to engage the strip with the rollers, as distinguished from the magnetic support means such as shown in the magnetic conveyor of the Bannister U.S. Pat. No. 2,750,187, and functionally this combination of magnets and rollers differentiates substantially therefrom in operation.

The magnets can be of a permanent type, or electromagnets, as desired. In FIG. 2 double bar magnets 140, 142 are shown arranged in side by side relationship on the plate 134, and are preferably substantially coextensive with the lengths of the rollers 120 so that the transverse width of the strip is maintained fully supported thereby. It is also to be noted that the gap, which can be, for example, between 1/32 inch to 1/16 inch, is adjustable to accommodate for greater or thinner strip thicknesses and yet maintain appropriate contact with the rolls.

A second embodiment of a strip support and separator unit is shown in FIG. 3. This unit, generally designated 146, is mounted on a support 148, and includes a plate 150 which serves to adjustably mount bar magnets 152 and 154 by means of threaded bolts 156, 158, in a manner similar to the preceding embodiment, for adjusting the relationship of the lower surfaces of the magnets with respect to the lower peripheral surfaces of rollers 160, 162 and 164. In this embodiment the rolls and rows of magnets are alternated, and as many sets of magnets and/or rolls can be used as might be desired for any given set of circumstances and structure.

Preferably the bar magnets are of the permanent type. In any event, the bar magnets when used with non-magnetic rolls as arranged in the present invention, provides a relatively constant magnetic field to maintain the strip flat. This structure is preferable to use of magnetic rolls such as in Bannister due in part to problems arising in use of magnetic rolls. Such rolls for example normally require a curved magnet, and can cause the effect of the magnetic field on the strip to vary. Many important and significant differences exist between the Bannister apparatus and that of the present invention. These differences result in substantial advantages and improvements in the present invention. The present apparatus provides, for example, a substantially greater magnetic attractive force. The attractive force of a magnet on the strip being processed varies inversely with the square of the distance between the magnet and the strip. For comparison, using the present arrangement, assume that the bar magnet, or bank of electro magnets for example, have a magnetic field which when projected on the surface of the strip is rectangular in shape, and dimensionally equal to the projected area of the magnetic roll employed in the Bannister apparatus.

With the present invention, the vertical distance between the surface of the magnet means and the strip surface is adjustable to any desired distance, and this vertical distance is virtually constant over the entire area of the magnet.

With the Bannister apparatus however, the vertical distance between the magnet roll and the strip is zero at the vertical center line of the roll, increasing to a distance equal to the roll radius at the leading and trailing edges of the roll.

With magnetic attraction varying inversely with the square of the distance between magnet and strip, the present arrangement will afford a greater magnetic attraction than the magnetic roll, and the larger the diameter of the magnetic roll, the greater the resulting advantage in the present apparatus.

A second advantage of the present invention over Bannister is that there is less tendency to mar or scratch the surface of the strip being processed. In many strip processing operations there is present on the strip a considerable quantity of ferrous scale which could be attracted to and adhere to the surface of the magnets, or magnet rolls.

In the Bannister arrangement, where the strip is actually in contact with and supported by the magnetic rolls, any scale or similar loose, hard foreign magnetic material which adheres to the roll will repeatedly come in contact with the strip as the roll turns, and such contact can result in marring or scratching the surface of the strip. This will be especially true, and very detrimental, in the case of galvanized or tin-plated strip.

In the present invention, on the contrary the rolls in contact with the strip are non-magnetic, hence, there is no magnetic attraction to cause scale to adhere to the rolls. Since an air gap exists between the strip and the magnets, some build up of scale on the surface of the magnets can be tolerated without resultant scratching or marring of the surface of the strip.

Further, in the Bannister apparatus, the strip is normally tangent to the roll along a line of contact extending the full width of the strip, with zero air gap between roll and strip along that tangent line. If the magnet roll picks up any particles of scale which adhere to the surface, an air gap equal in thickness to the particles of scale can be caused to exist between strip and roll except where the scale is deposited, but this would tend to diminish the attractive force of the roll on the strip.

In the present invention, since the support rolls are non-magnetic, there is no magnetic attraction to cause scale to adhere to the rolls, and thus diminish the attractive force as in the case of Bannister.

In use electro-magnets consume a substantial amount of energy so that when the magnets are not in use, i.e., when the strip is not engaged by the support and separating units upon movement, either to accumulate or dispense the material by transversing of the looper cars, means are contemplated and provided for de-energizing the electro magnets by movement of the looper car. Limit switches can be provided for example, as generally indicated at 166 in FIG. 1, with a contact tripper arm such as at 168 on the looper car. Additionally, drum control switches can be mounted on the winch drives in the nature of limit switches, as broadly indicated at 170, the exact nature and arrangement of these switches will be obvious to those skilled in the art.

While preferred embodiments of the invention have been shown and described herein, it is to be noted that variations can be effected within the spirit and scope of the invention so long as the system serves to support the top strand from above by a system of rollers and magnets such that no parts of the supporting system are in the path of the looper cars. The rolls and magnets are spaced at intervals above the top strand of the loop from structural supports outside the path of the looper car. The specific support units have magnets positioned between non-magnetic rolls, and the magnets are so adjustable as to bring the strip into contact with the rollers, in rolling contact therewith, but maintained out of contact with the magnet per se.

What is claimed is:

1. In a moving metal strip material processing line including a looper section with at least one looper car mounted for travel along a track structure in both a first direction to accumulate and store the moving metal strip material in a horizontal loop having upper and lower strands and a second direction to refeed the moving metal strip material from the horizontal loop into the remainder of the processing line, an upper support means for supporting the upper strand of the horizontal loop in a horizontal fashion without obstructing the travel of the looper car along the track structure, said upper support means comprising:

(a) a frame structure which surrounds the horizontal loop, said frame structure including a plurality of vertical frame members positioned at predetermined distances from the track structure such that said vertical frame members do not contact the looper car as the looper car travels along the track structure; and (b) a plurality of magnetic strip support and separator units respectively secured to said plurality of vertical frame members and positioned at a predetermined height above the track structure such that none of said plurality of magnetic strip support and separator units contacts the looper car as the looper car travels along the track structure, each of said plurality of magnetic strip support and separator units including a plurality of elongated, non-magnetic rollers mounted thereon in transverse relationship relative to the upper strand of the horizontal loop, each of said plurality of magnetic strip support and separator units also including magnetic means mounted thereon for lifting the upper strand into contact with said plurality of elongated, non-magnetic rollers and for supporting the upper strand in essentially horizontal fashion while the looper car travels along the track structure, said magnetic means having at least one elongated magnetic element located between adjacent elongated, non-magnetic rollers and positioned in spaced, transverse relationship relative to the upper strand such that an air gap is formed between said elongated magnetic element and the upper strand when said magnetic means lifts the upper strand into contact with said plurality of elongated, non-magnetic rollers.

2. An upper support means as set forth in claim 1, wherein said magnetic means includes an adjustment means for adjusting the position of said elongated magnetic element to vary the dimensions of said air gap.

3. An upper support means as set forth in claim 2, wherein each of said plurality of magnetic strip support and separator units also includes a beam portion from which a plurality of opposing leg means extend for rotationally mounting said plurality of elongated, non-magnetic rollers and said adjustment means includes an adjustable nut and bolt means for attaching each of said elongated magnetic elements to said beam portion.

4. An upper support means as set forth in claim 1, wherein said elongated magnetic element is a permanent magnet.

5. An upper support means as set forth in claim 1, wherein said elongated magnetic element is an electromagnet.

6. An upper support means as set forth in claim 5, including a switch means for selectively energizing and de-energizing each said electromagnet in said plurality of magnetic strip support and separator units in response to the travel of the looper car along the track structure.

7. A magnetic strip support and separator unit for use in supporting the upper strand of a horizontal loop in the looper section of a moving metal strip material processing line, said magnetic strip supporter and separator unit comprising:

(a) a supporting structure;

(b) a plurality of elongated, non-magnetic rollers respectively mounted on said supporting structure in transverse relationship relative to the upper strand of the horizontal loop, each of said plurality of elongated, non-magnetic rollers having a length greater than the width of the upper strand; and (c) magnetic means mounted on said supporting structure for lifting the upper strand of the horizontal loop into contact with said plurality of elongated, non-magnetic rollers, said magnetic means including at least one elongated magnetic element located between adjacent elongated, non-magnetic rollers and positioned in spaced, transverse relationship relative to the upper strand such that an air gap is formed between said elongated magnetic element and the upper strand when said magnetic means lifts the upper strand into contact with said plurality of elongated, non-magnetic rollers, said elongated magnetic element having a length substantially coextensive with said length of said elongated, non-magnetic rollers.

8. A magnetic strip support and separator unit as set forth in claim 7, including an adjustment means for adjusting the position of said elongated magnetic element to vary the dimensions of said air gap.

9. A magnetic strip support and separator unit as set forth in claim 8, wherein said supporting structure includes a beam portion from which a plurality of opposing leg means extend for rotationally mounting said plurality of elongated, non-magnetic rollers and said adjustment means includes a nut and bolt means for attaching said elongated magnetic element to said beam portion.

10. A magnetic strip support and separator unit for use in supporting the upper strand of a horizontal loop in the looper section of a moving metal strip material processing line, said magnetic strip support and separator unit comprising:

(a) a supporting structure;

(b) a plurality of non-magnetic rollers mounted on said supporting structure in transverse relationship relative to the upper strand of the horizontal loop; and (c) magnetic means mounted on said supporting structure for lifting the upper strand of the horizontal loop into contact with said plurality of non-magnetic rollers, said magnetic means including at least one magnetic element located between adjacent non-magnetic rollers and positioned in spaced relationship relative to the upper strand such that an air gap is formed between said magnetic element and the upper strand when said magnetic means lifts the upper strand into contact with said plurality of non-magnetic rollers, said magnetic means also including an adjustment means for adjusting the position of said magnetic element to vary the dimensions of said air gap.

11. In a moving metal strip material processing line including a looper section having a winch mechanism and a looper car connected to the winch mechanism for travel along a track structure in response to actuation of the winch mechanism, the looper car travelling in a first direction to accumulate and store the moving metal strip material in a horizontal loop having upper and lower strands while travelling in a second direction to refeed the moving metal strip material from the horizontal loop into the remainder of the processing line, an upper support means for supporting the upper strand of the horizontal loop in a horizontal fashion without obstructing the travel of the looper car along the track structure, said upper support means comprising:

(a) a plurality of vertical frame members positioned at predetermined distances from the track structure such that said vertical frame members do not contact the looper car as the looper car travels along the track structure;

(b) a plurality of magnetic strip support and separator units respectively secured to said plurality of vertical frame members and positioned at a predetermined height above the track structure such that none of the said plurality of magnetic strip support and separator units contacts the looper car as the looper car travels along the track structure, each of said plurality of magnetic strip support and separator units including a plurality of non-magnetic rollers mounted thereon in transverse relationship relative to the upper strand of the horizontal loop, each of said plurality of magnetic strip support and separator units also including energizable magnetic means mounted thereon for lifting the upper strand into contact with said plurality of non-magnetic rollers; and (c) switch means for providing a signal to selectively energize and de-energize said magnetic means in said plurality of magnetic strip support and separator units in response to the travel of the looper car along the track structure, said switch means including a rotary limit switch means mounted on the winch mechanism to sense the location of the looper car.

12. A method for supporting the upper strand in a horizontal loop of moving metal strip material, which horizontal loop is lengthened or shortened respectively by the travel of a looper car along a track structure in response to the actuation of a winch mechanism, said method comprising the steps of:

(a) positioning a plurality of non-magnetic rollers at a first predetermined height above the track structure such that the upper strand in the horizontal loop passes beneath the plurality of non-magnetic rollers as the horizontal loop is lengthened or shortened;

(b) positioning a plurality of electromagnets at both a location intermediate adjacent non-magnetic rollers and at a second predetermined height above the track structure such that the upper strand in the horizontal loop passes beneath the plurality of electromagnets as the horizontal loop is lengthened or shortened;

(c) generating a signal in response to actuation of the winch mechanism to indicate the location of the looper car along the track structure; and (d) selectively operating the plurality of electromagnets in response to said signal such that those electromagnets beneath which the upper strand in the horizontal loop passes are energized to lift the upper strand into contact with plurality of non-magnetic rollers as the horizontal loop lengthens or shortens while those electromagnets remaining beyond the horizontal loop as the horizontal loop lengthens or shortens are de-energized to conserve power.

* * * * *